US006209306B1

(12) United States Patent
Chia et al.

(10) Patent No.: US 6,209,306 B1
(45) Date of Patent: Apr. 3, 2001

(54) DECORATIVE JEWELRY ROPE CHAIN

(76) Inventors: Meang K. Chia; Cheo K. Chia; Huy K. Chia, all of 412 W. 6th St., Suite 1104, Los Angeles, CA (US) 90014

( * ) Notice: Subject to any disclaimer, the term of this patent is extended or adjusted under 35 U.S.C. 154(b) by 0 days.

(21) Appl. No.: 09/287,972

(22) Filed: Apr. 7, 1999

(51) Int. Cl.[7] ..... B21L 5/02

(52) U.S. Cl. ..... 59/80; 59/35.1; 59/82

(58) Field of Search ..... 59/35.1, 80, 82

(56) References Cited

U.S. PATENT DOCUMENTS

| | | | | |
|---|---|---|---|---|
| D. 313,372 | | 1/1991 | Kulla . | |
| D. 313,711 | | 1/1991 | Kulla . | |
| D. 326,065 | | 5/1992 | Borgogni . | |
| D. 329,828 | | 9/1992 | Bedoyan . | |
| D. 330,175 | * | 10/1992 | Kahan | D11/13 |
| D. 330,343 | | 10/1992 | Bedoyan . | |
| D. 335,834 | | 5/1993 | Grotto . | |
| D. 340,422 | | 10/1993 | Grando . | |
| D. 343,136 | | 1/1994 | Grando . | |
| D. 343,806 | * | 2/1994 | Bedoyan | D11/13 |
| D. 353,556 | | 12/1994 | Chia et al. . | |
| D. 359,010 | | 6/1995 | Rozenwasser . | |
| D. 362,203 | | 9/1995 | Grando . | |
| D. 368,048 | | 3/1996 | Rozenwasser . | |
| D. 370,184 | | 5/1996 | Rozenwasser . | |
| D. 370,426 | | 6/1996 | Rozenwasser . | |
| D. 398,551 | | 9/1998 | Kupelian . | |
| 1,055,751 | * | 3/1913 | Hurley | 59/80 |
| 1,886,784 | | 11/1932 | Roppenhausen . | |
| 4,348,861 | | 9/1982 | Nakagawa | 59/82 |
| 4,651,517 | | 3/1987 | Benhamou et al. . | |
| 4,934,135 | | 6/1990 | Rozenwasser . | |
| 4,996,835 | | 3/1991 | Rozenwasser . | |
| 5,125,225 | | 6/1992 | Strobel . | |

(List continued on next page.)

FOREIGN PATENT DOCUMENTS

| | | | | |
|---|---|---|---|---|
| 0 470 937 | | 2/1992 | (EP) . | |
| 2446612 | * | 9/1980 | (FR) | 59/80 |

OTHER PUBLICATIONS

Bisarello Pietro S.r.l., 36010 Cavazzale (Vicenza)—Italy (2 pages).
"Solid Gold Bracelets", p. 7.
Fancy Jewelry Imports, p. 45, 650 S. Hill St. Suite 228, Los Angeles, CA 90014.
Chrysos S.r.l, Cover Page, Via Vallina Orticella, 16, 31030 Borso del Grappa (Treviso)—Italy.
Leslie's Jewelry at New York, vol. 698, p. 65, Item 203–3.
Armburst Chain Co. Catalog, 735 Allens Ave., Providence, RI 02905, pp. 15, 145, 151, 100, 1975.*
L'Oromeccanica, Via Marchesane 115A/36065 Musselente (Vicenza) Italy 2 pages, 1982.*
Aurora, Via Vecchia Ferriera 70, 36100 Vicenza, Italy, 1997.*
Copy of 17 " Rope Chain Necklace, Item No. 459738400, Montgomery Ward Stores.
Copy of 7" and 18" Rope Chain Bracelet and Necklace, Item No. 459738301, Montgomery Ward Stores.

*Primary Examiner*—David Jones
(74) *Attorney, Agent, or Firm*—Ladas & Parry

(57) ABSTRACT

A decorative rope chain and a manufacturing process to produce a rope chain in which each link used as a basic building element exhibits a unique visual property, such as surface texture, coloration, attribute, feature, characteristic, shape or other physical appearance. Such unique visual property traits for the succession of links results in a more attractive, fanciful, more delicate and interesting fashion item. In one aspect of the invention, each of the interconnected links has a first side surface exhibiting a first visual property and an opposite second side surface exhibiting a second, perceptively different, visual property. In other aspects of the invention, the side surfaces of the links may have differently colored, textured, or patterned surface portions. In yet another aspect of the invention, each link may have differently shaped portions.

75 Claims, 6 Drawing Sheets

U.S. PATENT DOCUMENTS

| | | | | |
|---|---|---|---|---|
| 5,129,220 | | 7/1992 | Strobel . | |
| 5,185,995 | | 2/1993 | Dal Monte . | |
| 5,285,625 | | 2/1994 | Ofrat et al. . | |
| 5,301,498 | | 4/1994 | Chia et al. . | |
| 5,303,540 | | 4/1994 | Rozenwasser | 59/80 |
| 5,309,704 | | 5/1994 | Grando . | |
| 5,339,655 | | 8/1994 | Grando . | |
| 5,353,584 | | 10/1994 | Strobel et al. . | |
| 5,361,575 | | 11/1994 | Rozenwasser . | |
| 5,408,820 | | 4/1995 | Strobel et al. . | |
| 5,412,935 | | 5/1995 | Rozenwasser | 59/80 |
| 5,425,228 | * | 6/1995 | Hillel | 59/80 |
| 5,437,149 | | 8/1995 | Strobel . | |
| 5,452,572 | | 9/1995 | Alvaro et al. . | |
| 5,471,830 | | 12/1995 | Gonzales . | |
| 5,487,264 | | 1/1996 | Strobel . | |
| 5,526,639 | | 6/1996 | Gonzales . | |
| 5,531,065 | | 7/1996 | Rozenwasser . | |
| 5,537,812 | | 7/1996 | Rozenwasser . | |
| 5,542,244 | | 8/1996 | Chia et al. . | |
| 5,544,477 | | 8/1996 | Rozenwasser | 59/13 |
| 5,581,993 | | 12/1996 | Strobel . | |
| 5,626,012 | * | 5/1997 | Fabbro | 59/35.1 |
| 5,653,100 | | 8/1997 | Dal Monte . | |
| 5,660,036 | | 8/1997 | Rozenwasser . | |
| 5,682,736 | | 11/1997 | Chia et al. . | |
| 5,775,088 | | 7/1998 | Grosz . | |
| 5,797,258 | | 8/1998 | Strobel et al. . | |
| 5,911,677 | | 6/1999 | Kupelian . | |

* cited by examiner

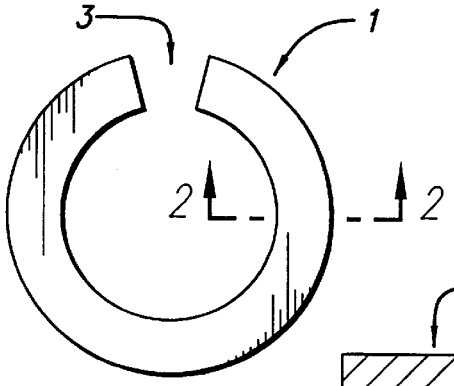
FIG. 1
PRIOR ART
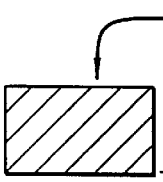
FIG. 2
PRIOR ART
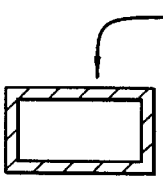
FIG. 2A
PRIOR ART
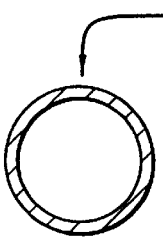
FIG. 2B
FIG. 3
PRIOR ART
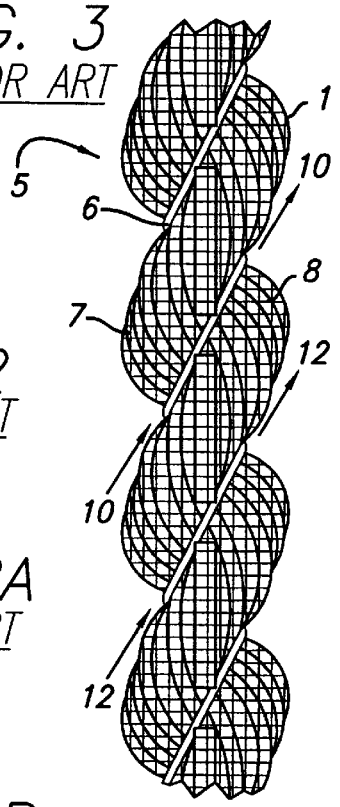
FIG. 4
PRIOR ART
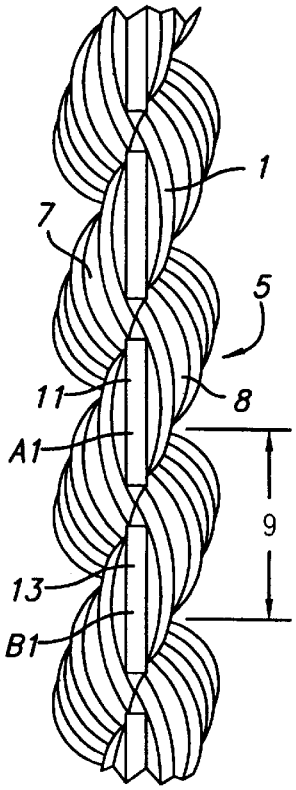
FIG. 5
PRIOR ART
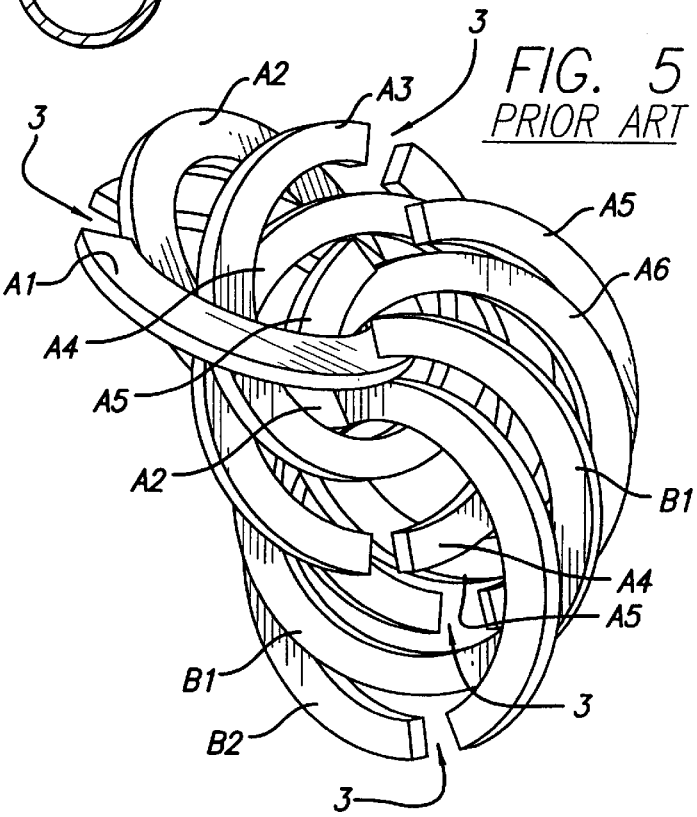

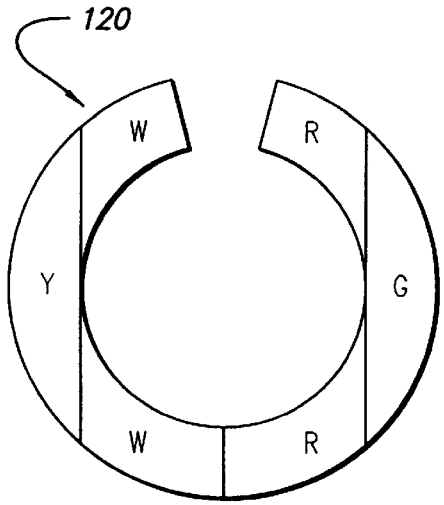
FIG. 18
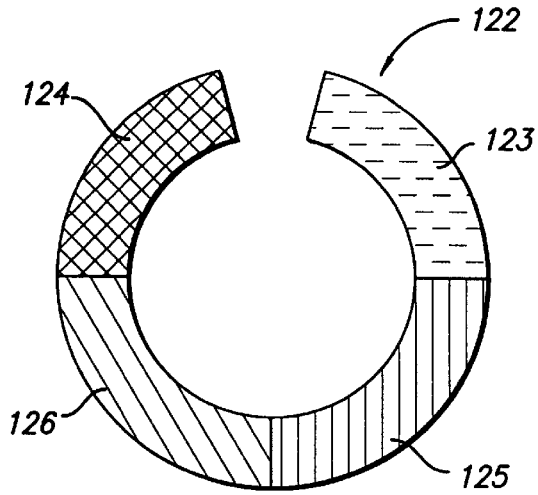
FIG. 19
FIG. 20
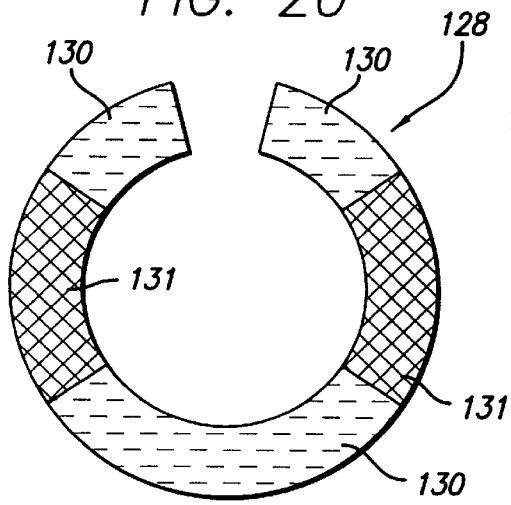
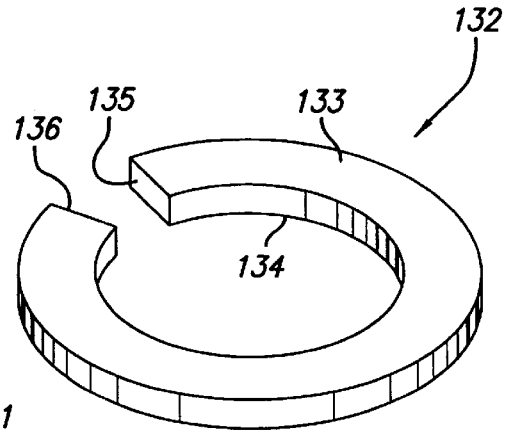
FIG. 21

DECORATIVE JEWELRY ROPE CHAIN

BACKGROUND OF THE INVENTION

1. Field of the Invention

This invention relates to the field of decorative jewelry items, and more particularly to a jewelry rope chain exhibiting unusual visual properties.

2. Brief Description of the Prior Art

Jewelry rope chain has been made for many years. Although rope chains can be made by machine, the better quality rope chains are usually manufactured by hand. While a rope chain has the feel and look of a rope, it is actually made up of a series of individual C-shaped flat links made from a precious metal such as silver or gold. Gold is available in at least four colors; white, yellow, rose (pink), and green. The C-shaped links are gapped and fastened together in a particular way, such that tightly interlinking annular links give the appearance of intertwining helical rope strands. The links of hand-made rope chains are made with a tighter fit and are more visually appealing than are machine-made rope chains. A number of annular links are connected and intertwined together in a systematic and repetitive pattern of orientation, resulting in an eye-pleasing, flexible, and delicate-appearing chain that looks and feels like a finely braided helix.

In a conventional rope chain, the orientation pattern of individual links producing the rope chain is repeated every several links, for example every four links, and as such is referred to as a four-link rope chain. In an improvement to the conventional basic rope chain, it is taught in U.S. Pat. No. 4,651,517 that the links can be constructed in different and narrower dimensions so that the pattern is repeated every six links or even every eight links. In U.S. Pat. No. 5,301,498, to Chia et al., it is suggested that, by narrowing the cross-section of the link, the six-link rope chain's connected segments appear finer than those of the four-link version and consequently provides a more delicate and refined presentation than that obtainable with a four-link rope chain arrangement. While the '517 patent uses a six-link rope chain as a preferred embodiment, that patent teaches the formulas for creating rope chains consisting of a repeated series of six, eight, or more links.

Some manufacturers of jewelry use different colored gold and silver elements to enhance the beauty of the jewelry article. Examples are: rope chains in which sets of links of one color alternate with sets of links of another color; and bracelets or necklaces constructed of interconnected twisted loops exhibiting alternating colors along their lengths.

However, in all of the prior art construction techniques for producing rope chain jewelry, each link is of a single solid color, texture, and pattern, e.g., each link may be stamped from a solid thin sheet of precious metal, such as gold. Thus, for example, while an all yellow gold rope chain or an all white gold rope chain is attractive, it is otherwise uninteresting due to the monotonic nature of its unvarying coloration and/or texture along the links of the chain. Those prior art rope chains that do exhibit variations of colors along their lengths nevertheless are constructed of individual links each of which is of a single solid color, texture, and/or pattern. Other jewelry articles exhibit variations of colors along their lengths using interconnected twisted chain loops, but they are not regarded as rope chains as defined herein.

SUMMARY OF THE INVENTION

The present invention provides the means and method for assembling links in a manufacturing process to produce a rope chain piece of jewelry in which each link exhibits a unique visual property, i.e., surface texture, coloration, attribute, feature, characteristic, or physical appearance. Such unique visual property traits for the succession of links results in more attractive, fanciful, more delicate and interesting fashion jewelry item.

In one aspect of the invention, each of the interconnected links has a first side surface exhibiting a first visual property and an opposite second side surface exhibiting a second, perceptively different, visual property.

In another aspect of the invention, rather than having each link side surface of a uniform visual property, one of the side surfaces, or both such side surfaces, may exhibit perceptively different visual properties in accordance with a predetermined pattern arrangement on each side surface. The two side surfaces so configured may be identical on both first and second side surfaces, or they may be different one from the other. For example, a portion of each first side surface may be of a first color, and another portion may be of a second color. Similarly, a portion of each second side surface may be of a first color, and another portion may be of a second color, and the design of the arrangement of different colored portions may be different on the first and second side surfaces.

Instead of, or in addition to, differently colored portions, the two side surfaces may exhibit differently textured or patterned portions, e.g., one portion may be shiny while another portion may have a patterned, sandblasted, frosted, or matte finish appearance. Also, either side may be of a solid color, texture, or pattern, while the other side is portioned as described. Thus, it will be understood that in all of the examples of the accompanying figures and the related text, where different colors are shown and described, texture or patterns can be shown, and the terms "texture" or "pattern" can be substituted. To avoid unnecessary duplication, however, color will be used as exemplary of other visual properties including surface texture and patterns.

Instead of, or in addition to, differently colored, patterned, and/or textured portions, the interconnecting links may have different shapes or shaped portions. For example, some or all of the links making up the rope chain may be smoothly circular, circular with peripheral undulations or crenels, circular with peripheral gear-like teeth, may be star shaped, baguette shaped, square shaped, rectangular shaped, oval shaped, diamond shaped, heart shaped, etc. Similarly, different portions of each link may have such different physical shapes.

As a result of the various combinations possible in the manufacture of jewelry rope chains in accordance with the present invention, a virtually limitless number of different design possibilities exist, and preferred ones of such possibilities are shown and described herein. It is to be understood, however, that all combinations of: the number of interconnected links in the repeated pattern along the rope chain; solid or portioned coloration and/or texturing; different designs of the portioned regions of each side surface of the links; and different physical shape and/or visual properties as identified in this description may be employed in the manufacture of jewelry rope chains and are contemplated as variations of the preferred embodiment specifically shown and described.

BRIEF DESCRIPTION OF THE DRAWING

Further objects and advantages and a better understanding of the present invention may be had by reference to the following detailed description taken in conjunction with the accompanying drawings in which:

FIG. 1 is a plan view of an annular link element which is the basic building element for the construction of jewelry rope chains as known in the prior art;

FIG. 2 is a cross sectional view of a solid core annular link element taken along the lines 2—2 in FIG. 1, also known in the prior art;

FIG. 2A is a view similar to that of FIG. 2, except that the link element is rectangular and hollow in cross section, known in the prior art;

FIG. 2B is a view similar to that of FIG. 2A, except that the link element is circular and hollow cross section;

FIG. 3 is a side elevational view showing a section of a prior art rope chain during the manufacturing process, before removing a forming wire used to maintain proper orientation of the series of links;

FIG. 4 is a front elevational view of the outward appearance of a jewelry rope chain of the prior art showing a uniform visual appearance for all links in the chain for the entire length thereof;

FIG. 5 is a perspective view of a number of loosely interconnected links in an expanded view to show the method of interlinking to form sets of links in the series of links along the rope chain, as is known in the prior art;

FIG. 18 is a plan view of a sixth example of an annular link showing a pattern of regions on the surface of the link exhibiting four different visual color properties;

FIG. 19 is a plan view of a seventh example of an annular link showing a pattern of regions on the surface of the link exhibiting four different visual color properties;

FIG. 20 is a plan view of an eighth example of an annular link showing a pattern of four regions on the surface of the link exhibiting two different visual color properties;

FIG. 21 is a perspective view of a gapped link, similar to any one of those depicted in FIGS. 1, 6–11, 18, and 19, except that it has a virtually flat, but non-planar upper and lower major surfaces;

DETAILED DESCRIPTION OF THE PREFERRED EMBODIMENTS

Figure 6:
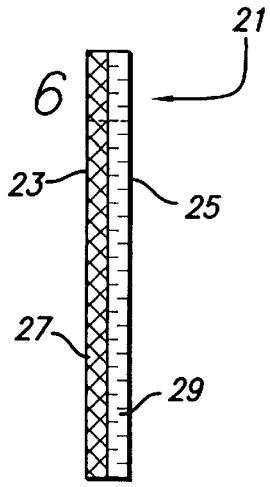
FIG. 6 is a side elevational view of an annular link used in the manufacture of one embodiment of a rope chain in accordance with the present invention.

FIG. 1 is a plan view of an annular link used in the construction of jewelry rope chains as known in the prior art. In general, FIGS. 1–5 depict a conventional rope chain arrangement (FIGS. 3 and 4), a typical annular link (FIGS. 1 and 2) employed as a basic building element in the construction of the rope chain, and a number of loosely interconnected annular links (FIG. 5) to illustrate the positional relationship of adjacent annular links along the rope chain.

For the purposes of this description, the following definitions are provided.

"Rope chain" is a series of sets of interlinked, or interconnected, link elements which has the appearance of a plurality of braided, or helically intertwined, multi-fiber strands of hemp, flax, or the like.

A "set" is the number of adjacent interlinked, or interconnected, links making up a structurally repeated pattern along the chain. In the accompanying drawings and associated text, a six-link set is used for purposes of ease of visual presentation and description. The preferred number of links in a set is eight.

A "group" is a number of adjacent interlinked, or interconnected, links exhibiting identical visual properties. The number of links in a group may be the same or different than the number of links in a set. Groups may be uniformly or randomly distributed along the rope chain.

A "link" is the basic building element, a number of which are assembled in series to form a rope chain. A link is typically annular in shape with an open gap having a length slightly greater than the width of the annular link. In accordance with the invention, a link may have a circular, baguette, oval, diamond, rectangular, square, heart shaped, or other geometrical shape, and each is provided with a gap at a selected position along the perimeter thereof. Accordingly, while the links of a rope chain are not necessarily annular, it is the preferred configuration for the basic building element of a rope chain, and for that reason an annular link will be used in most of the examples shown and described herein.

A "channel" is the path which the eye follows in passing along the rope chain at the apex of the V-shaped helical groove formed between the apparent intertwined rope braids. Hence, in the preferred embodiments described herein, the rope chain has the appearance of a pair of intertwined braids of ropes, and thus there exists two such helical channels offset from one another by one-half of the pitch of either helix.

A "visual property" , as used herein, is a characteristic of an object which presents a particular visual image to the eye. Such characteristics include, but are not limited to, color, texture, pattern, or physical shape. Although shape is also a physical property of an object, in the art of jewelry making, it is often the physical shapes which impart beauty and delicateness to a fashion item.

Referring now to FIGS. 1 and 2, an annular link 1 is shown to have a generally rectangular cross section (FIG. 2) and a gap 3 having sloping edges, the narrowest width of gap 3 being slightly larger than the thickness of the annular link 1.

While conventional rope chains are constructed using annular links having a rectangular cross section as shown in FIG. 2, variations with different cross sectional geometries are possible. FIGS. 2A and 2B depict two such variations. The cross section of tubular link 1A in FIG. 2A is rectangular and hollow (known from U.S. Pat. No. 4,651,517). Another variation is shown in FIG. 2B in which the tubular link element 1B has a hollow circular cross section. All of the link element embodiments and variations of the present invention illustrated in FIGS. 6–26 can be solid or hollow in cross section, and may have any geometrical cross sectional configuration. A non-limiting solid rectangular cross section is chosen as exemplary in the accompanying drawings for illustrative purposes only.

Conventional rope chains, such as those shown in FIGS. 3 and 4, are made with a systematic and repetitive interlinking of basic annular links 1. The annular link 1 must meet certain dimensional requirements for the interlinking to result in a well-fitting rope chain. Such dimensions are known in the art and will vary from a four-link variety to a six-link variety to an eight-link variety, and so on. Determining the proper dimensions for the annular link 1 and the gap 3 therein, depending upon the number of desired links to form a set of interlinked links, can be readily understood by reference to the aforementioned U.S. patents, especially U.S. Pat. No. 4,651,517. As can be viewed in FIGS. 3 and 4 herein, the intertwined links 1 of a segment of a conventional rope chain 5 are shown in FIGS. 3 and 4 in the form of a six-link variety. In their assembled form, the series of links 1 produce the appearance of a first braid of rope 7 and a second braid of rope 8, the combination of which results in a double intertwined helical appearance.

As best seen in FIGS. 3 and 4, the apparent intertwining of a pair of rope braids 7 and 8 results in a V-shaped groove between the braids at any position along the rope chain. The path along the apex of such V-shaped groove is referred to herein as a "channel", and since there are two apparent rope braids 7 and 8, there are, likewise, two defined channels indicating FIG. 3 by the directional arrows 10 and 12. Channel 10, along the length of the rope chain, defines a helix, as does channel 12. However, the two channels never intersect one another, and are parallel to one another along the length of the rope chain separated axially by one half of the pitch of either of the two channels. In the prior art of FIGS. 3 and 4, there is no visual difference between following along the two helical channels 10 and 12, since the rope chain is comprised of a repetitive series of sets of links 1, and all links have the same visual property (they are all of the same color, texture, and shape, for example).

FIG. 3 is a side elevational view showing a section of a prior art rope chain during the manufacturing process, before removing a forming wire used to maintain proper orientation of the series of links.

Further with respect to FIG. 3, in the construction of a rope chain using annular links 1, it is necessary to maintain a tightly interlinking of the annular links until the entire rope chain is completed, and for that purpose, a pair of support wires 6 are positioned in the channels 10 and 12 and are kept in place until such time as a means of fixing the assembled links 1 together is completed. In U.S. Pat. No. 4,651,517, for example, after building up the links in the manner described therein, to form the double helix chain, the links are held in the desired juxtaposition temporarily by a thin metal wire wrapped around the links. Then, solder is intermittently applied to every pair of adjacent links at the external periphery thereof. The wire is then removed and does not comprise a part of the completed rope chain.

FIG. 4 is a front elevational view of the outward appearance of a jewelry rope chain of the prior art showing a uniform visual appearance for all links in the chain for the entire length thereof.

In FIG. 4, the distance denoted by numeral 9 encompasses the links of a "set" of links, and it will be noted that links 11 and 13 lie in the same plane, but are angularly displaced from one another along the links of the rope chain by 180°. That is, following the position of link 11 counterclockwise (as seen from the top) and downwardly, it will be observed that each subsequent link is angularly spaced at a constant 30° angle, and since there are six links per set, a 180° turn of link 11 downwardly along the rope chain will be effectively rotated 180° to assume the position of link 13. As is clearly visible in FIG. 4, a series of sets of links 1 makes up the length of rope chain illustrated.

For an eight-link "set" (not shown, but defining a preferred embodiment), each subsequent link will be angularly spaced at a constant 22.5° angle.

FIG. 5 is a perspective view of a set of loosely interconnected links in an expanded view to show the interlinking of the links to form a set of links in the series of links along the rope chain, as is known in the prior art. The drawing of FIG. 5 is copied from U.S. Pat. No. 4,651,517 (FIG. 8g thereof), and shows a number of annular links A1–A6, B1 and B2, each with a gap 3 permitting the complex interlinking arrangement shown. A set of annular links A1–A6, when tightly assembled, results in the structured, repeated, pattern shown in FIG. 4 with the annular link A1 of a first set of links lying in the same plane as the first annular link B1 belonging to the next adjacent set of annular links B1–B6 (only links B1 and B2 shown).

In the remaining figures to be described, FIGS. 6–11 illustrate variations of the present invention in which the annular links are manufactured with a variety of different appealing visual properties.

In FIG. 6, for example, the plan view of the annular link 21 has one planar side, or facial, major surface 23 (hereinafter referred to as a first side surface) of a first color and the opposite planar side, or facial, major surface 25 (hereinafter referred to as a second side surface) of a different color. The link 21 may be formed, for example, by stamping a flat sheet constructed of two laminated layers of different flat materials, or of two laminated layers of materials of different colors, and/or textures.

In this connection, all of FIGS. 6–20 have portions lined or marked to show the colors yellow gold, white gold, rose (pink) gold, and green gold, indicating that, for a jewelry article such as a rope chain, the preferred colors are yellow gold and white gold, but rose and/or green gold areas may also be popular, especially with younger people. In all of the FIGS. 6–20, the portions of the annular links, and therefore the rope chain, lined for gold colors may be a result of gold plating a metallic annular link, such that the color of side surfaces 23 and 25 extends beyond the edges to meet in the middle of the annular edge (as shown), or either one of the colors may extend the full width of the edge of the annular link 21 (not shown). Alternatively, as suggested by FIG. 6, the links may, for example, be laminated with a yellow gold layer 27 and a white gold layer 29. It is also within the scope of the present invention to use gapped links that have been enameled or otherwise surface coated.

Figure 7:
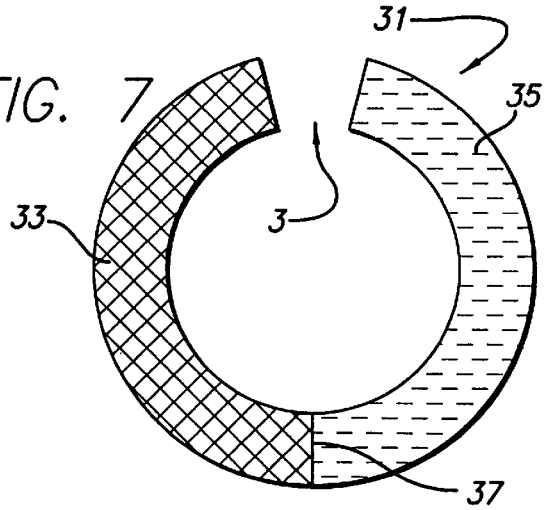
FIG. 7 is a plan view of a first example of an annular link showing a pattern of regions on the surface of the link exhibiting different visual properties.

FIG. 7 is a plan view of a first example of an annular link showing a pattern of regions on a surface of a link 31, exhibiting different visual properties. In FIG. 7, annular link 31 is divided along a line 37 such that one half 33 of the annular link 31 between the dividing line 37 and the gap 3 is yellow gold colored, while the other half 35 is white gold colored. Again (as with all variations shown in FIGS. 6–11), these colored surfaces 33, 35 may be differently plated, or each link portion may be made from a solid precious metal such as yellow gold and white gold. In the latter case, the gapped links may be stamped from a multicolored flat sheet, striped with a number of alternately colored gold materials, or alternately striped with different materials such as gold and silver. Such a striped flat sheet may be stamped to form gapped links in different orientations relative to the stripe pattern and relative to the gap position, resulting in a variety of interesting colored patterns in the finished rope chain, yet all such links can be stamped from the same striped sheet.

Figure 8:
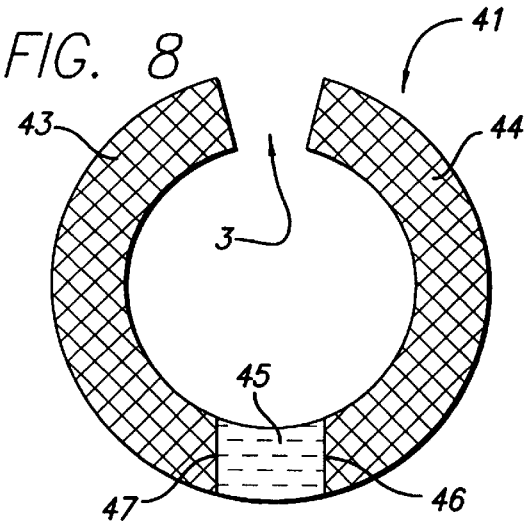
FIG. 8 is a plan view of a second example of an annular link showing a pattern of regions on the surface of the link exhibiting different visual properties.

FIG. 8 is a plan view of a second example of an annular link 41 showing a pattern of regions on the surface of the link exhibiting different visual properties. In FIG. 8, the annular link 41 has two major curved portions 43, 44 of yellow gold, while a small section 45 is white gold, the section 45 being defined by separating lines 46 and 47.

Figure 9:
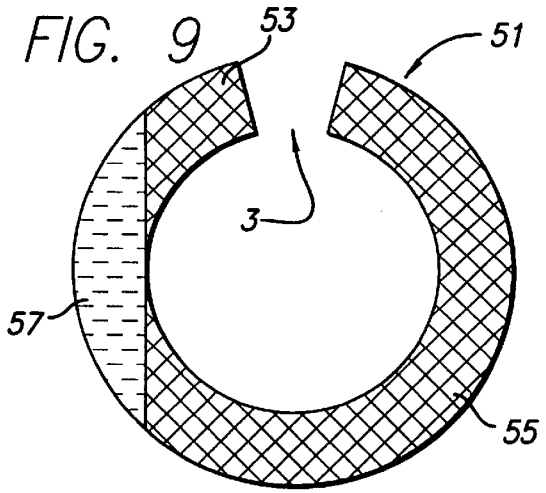
FIG. 9 is a plan view of a third example of an annular link showing a pattern of regions on the surface of the link exhibiting different visual properties.

FIG. 9 is a plan view of a third example of an annular link 51 showing a pattern of regions on the surface of the link exhibiting different visual properties. In FIG. 9, the annular link 51 has a major curved portion 55 and a minor curved portion 53 of a yellow gold color, while a sector 57 of the annular link 51 is white gold.

Figure 10:
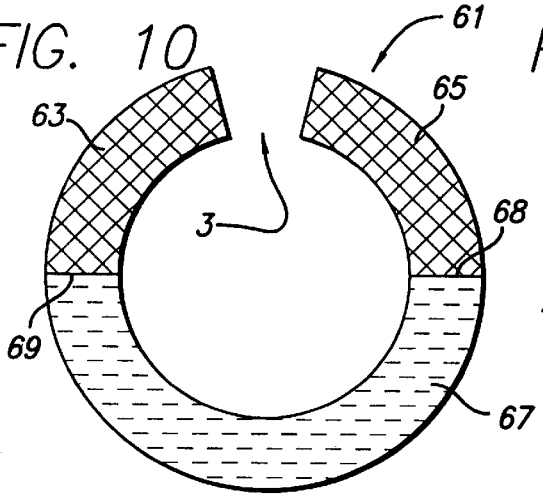
FIG. 10 is a plan view of a fourth example of an annular link showing a pattern of regions on the surface of the link exhibiting different visual properties.

FIG. 10 is a plan view of a fourth example of an annular link 61 showing a pattern of regions on the surface of the link exhibiting different visual properties. This figure shows yet another variety of coloration in which the annular link 61 is divided along a diameter defined by separating lines 68, 69 above which portions 63 and 65 are yellow gold, and below which portion 67 is white gold.

Figure 11:
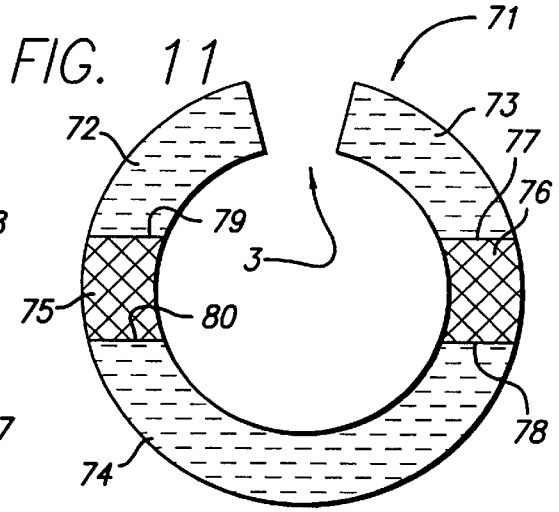
FIG. 11 is a plan view of a fifth example of an annular link showing a pattern of regions on the surface of the link exhibiting different visual properties.

FIG. 11 is a plan view of a fifth example of an annular link 71 showing a pattern of regions on the surface of the link exhibiting different visual properties. FIG. 11 shows another possibility in which annular link 71 has a yellow gold band 75, 76 along a diameter of the link defining separating lines 77–80, above which, a pair of curved portions 72, 73 are of white gold, and below which an arcuate portion of the link 71 is also of white gold.

Figure 12:
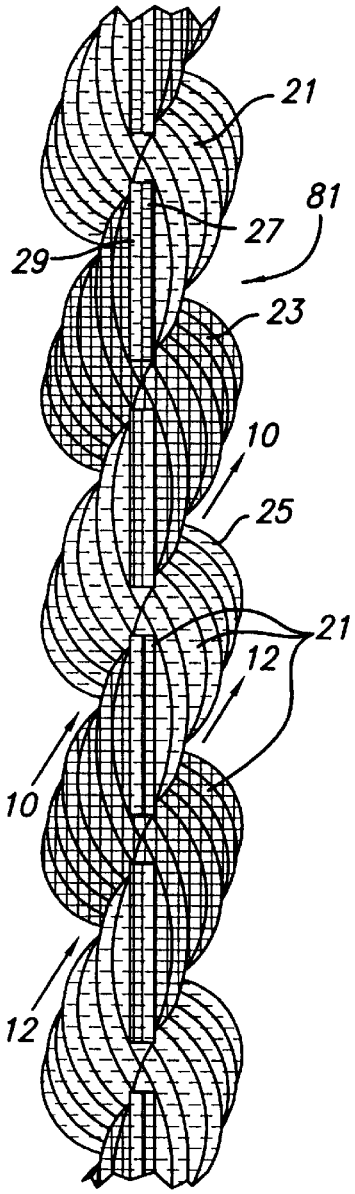
FIG. 12 is a schematic representation of a rope chain segment employing annular links of the type shown in FIG. 6, the figure lined for the colors yellow gold and white gold.

FIG. 12 is a schematic representation of a rope chain segment employing annular links of the type shown in FIG. 6, the figure lined for the colors yellow gold and white gold. The rope chain 81 of FIG. 12 is constructed from a continuous series of annular links 21 as shown in FIG. 6. One side 23 of the annular link 21 is yellow gold, and the other side 25 is white gold, and the white gold side of all links face the same direction along the length of the rope chain 81, as does the yellow gold side but in the opposite direction. Accordingly, the channel 10 will have a continuous length of white gold at, and extending outwardly from, the apex of the V-shaped channel 10, while the channel 12 will display a continuous color of yellow gold.

While the flat two-dimensional drawing of FIG. 12 is lined accurately with respect to the two different colors yellow gold and white gold, it may appear at first glance that a white gold portion 25 is to the right and a yellow gold portion 23 is to the left at some points along channel 10, for example at the position of the top arrow 10 in FIG. 12. However, when visualizing the three-dimensional aspect of the rope chain, and following channel 10 mentally along the rope chain 81, in passing around the right side of the rope chain 81 toward the rear along channel 10, the right portion of all of the annular links 21 will be viewed from a different angle from that shown in the two-dimensional drawing of FIG. 12.

That is, the rear side of each link to the right of the axis of rope chain 81 and shown as yellow gold in FIG. 12 is, in fact, white gold, and similarly, the rear side of each white gold colored surface 25 in FIG. 12, as viewed from the other side is yellow gold. The rope chain 81 of FIG. 12 thus imparts a very interesting and attractive coloration for the rope chain 81 having alternate yellow gold and white gold portions viewable from a particular viewpoint, and yet the rope chain 81 displays the interesting aspect of a continuous yellow gold helical channel paralleling a white gold helical channel.

Figure 13:
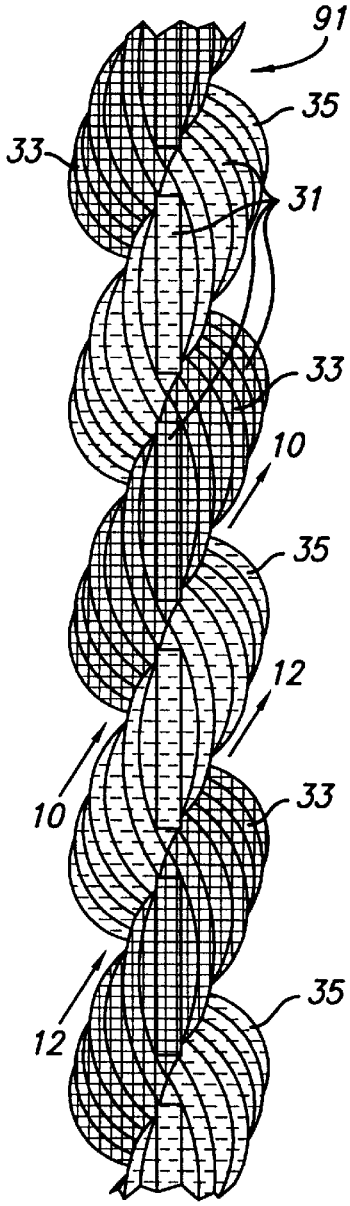
FIG. 13 is another embodiment of a rope chain segment employing annular links of the type shown in FIG. 7, the figure visually suggesting alternate helical rope strands lined to show the color yellow gold alternating with the color white gold.

FIG. 13 is another embodiment of a rope chain 91 showing alternate helical strands lined to show the color yellow gold alternating with the color white gold, or a gold material (33 in FIG. 7) alternating with a silver material (35 in FIG. 7). The yellow gold/white gold (or silver) pattern shown in FIG. 13 for the rope chain 91 is the result of assembling a series of annular links 31 as shown in FIG. 7. It will be appreciated from the drawing of FIG. 13 that the links 31 that are perpendicular to the page and shown as a yellow gold color will have a white gold or silver color as viewed from the rear thereof. Similarly, the white gold or silver colored links 31 shown perpendicular to the page in FIG. 13 are yellow gold colored in the rear view thereof. Likewise, any link 31 having a yellow gold colored exposed surface to the right of the axis of rope chain 91 in FIG. 13 will have a white gold or silver color on its exposed surface on the left side of the axis, and vice versa. Accordingly, following along channel 10 for the entire length of the rope chain 91, the right side of the channel will be white gold or silver colored and the left side will be yellow gold colored. Similarly, following along channel 12, the left side will be white gold or silver and the right side will be yellow gold.

Thus, in the configuration of FIG. 13, although all annular links 31 are identical and arranged in the same direction along the rope chain 91, nevertheless, the visual appearance is such that an apparent yellow gold colored rope is intertwined with an apparent white gold or silver colored rope, lending an interesting alternately colored appearance along the rope chain 91.

Figure 14:
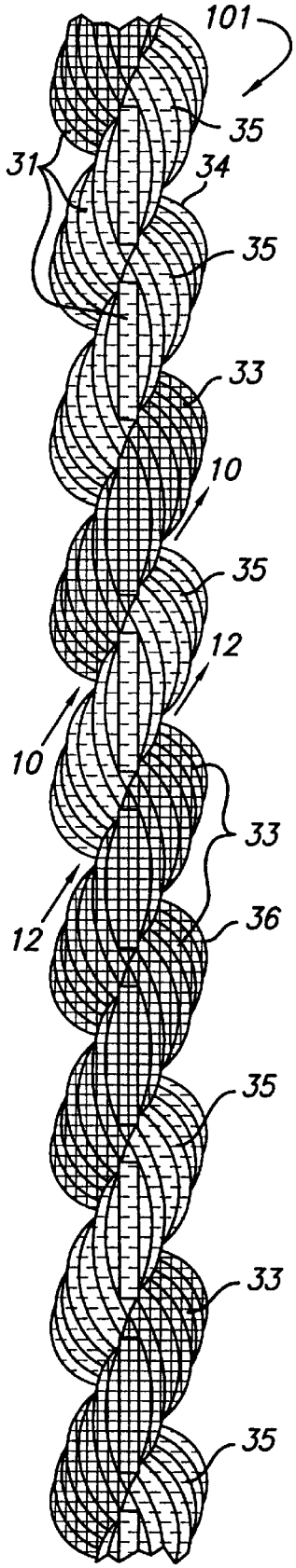
FIG. 14 is a view similar to that of FIG. 13, with a number of annular links inserted in the series of links in reverse direction every two twists of the apparent strands of the rope chain.

FIG. 14 is a rope chain 101 configured similar to that of FIG. 13, but with a number of annular links 31 inserted in the series of links in reverse direction every two twists of the strands of the rope chain 101. The rope chain 101 in FIG. 14 is thus constructed of a similar series of annular links 31 as shown in FIG. 7, except that the yellow gold and white gold halves 33, 35 are arranged adjacent one another for a series of three sets, and then the yellow gold and white gold sides 33, 35 are reversed for the next three sets. For example, in FIG. 14, a transition from a white gold colored half to a yellow gold colored half occurs at link 34 near the top of the segment of rope chain 101, while the yellow gold halves are adjacent one another from the bottom of FIG. 14 up to point 36 at which the yellow gold and white gold sides are reversed. With this configuration, another interesting yellow gold/white gold attractive pattern is produced which has a repetitive pattern along the rope chain 101 as follows (y meaning yellow gold and w meaning white gold): y,w,y,y, w,y,w,w/y,w,y,y,w,y,w,w/, etc. Of course, the left and right views of FIG. 14 would show a transition between yellow gold and white gold at the points 34 and 36, whereby, for example, in a view from the right of FIG. 14 at link 34, to the left of link 34 would be white gold and to the right of link 34 would be yellow gold.

Other attractive yellow gold/white gold patterns are possible when employing the concepts of the present invention, including, but not limited to: w,w,y,w,w,y or w,w,w,y,w,w, w,y or w,w,y,y,w,w,y,y, etc. Using other available gold colors, such as rose (r) and green (g), additional color patterns can be created, such as: w,w,y,r,r,y,g,g,y,r,r,y,w,w.

It is to be understood that the described specific examples of color patterns in a repeated set are not to be taken as limiting. An appealing rope chain may be formed by arranging sets of different color patterns in any combination, i.e. such a rope chain will have color patterns that differ along the length of the rope chain set-to-set. For example, a rope chain may have the repetitive set pair y,w,y,y,w,y,w,w and y,y,w,w,y,y,w,w repeated along the chain producing the structure: y,w,y,y,w,y,w,w/y,y,w,w,y,y,w,w//y,w,y,y,w,y,w,w/ y,y,w,w,y,y,w,w//(etc.). Alternatively, a rope chain may have a non-repetitive set pattern with each set along the chain having a different color pattern producing, for example, the color scheme: y,w,y,y,w,y,w,w/y,y,w,w,y,y,w,w/w,r,r,y,g,g,y, w/ (etc.,all sets different). Combinations of a repeated set, repeated set pairs or set triplets or set quads etc., non-repetitive sets, or random sets of different color patterns are also within the scope of the present invention.

A visually pleasing rope chain construction can be created, as another example, using the link element 31 of FIG. 7 to produce the rope chain appearance in FIG. 13. The FIG. 13 pattern as described may extend for a length of one inch with each set being repeated as shown in FIG. 13. The next one inch of rope chain may then comprise repeated sets of link elements of different colors, textures, or shapes, as desired, followed by a one inch length duplicating the first one inch segment. Such a finished rope chain will show a series of one inch segments having alternating visual properties.

After the assembly of a rope chain is completed, portions of the chain may be selectively rhodium coated to enhance the brilliance and luster of the coated part. In FIG. 13, for example, after construction, the white gold halves 35 of each link element 31 (FIG. 7) may be coated with rhodium which brightens the white gold helix and increases the contrast between the rhodium coated helix and the yellow gold helix. To the eye, this increased contrast effect makes the yellow gold helix appear to be even more yellow in color.

If desired, the jewelry designer may choose to give the finished rope chain a soft lusterless appearance, i.e., instead of rhodium coating to increase reflectivity and brilliance, the finished rope chain may be mechanically or chemically treated so as to have a sandblast, matt, or frost like finish.

Another possibility with the present invention is the ability to assemble virtually any color, texture, or shape combination along the length of the rope chain not grouped into patterns correlated with the number of links elements in a set. That is, a color/texture/shape combination, repeated or not, may extend along any number of links and not be bounded by the chosen number of links per set. One example of this is a rope chain having color patterns in groups of thirteen links, while a set for this particular rope chain may comprise eight links. Moreover, it is within the scope of the present invention to construct a rope chain with sets made up of different numbers of links, e.g., 4-link, 6-link, and 8-link sets used in the construction of the same rope chain.

Figure 15:
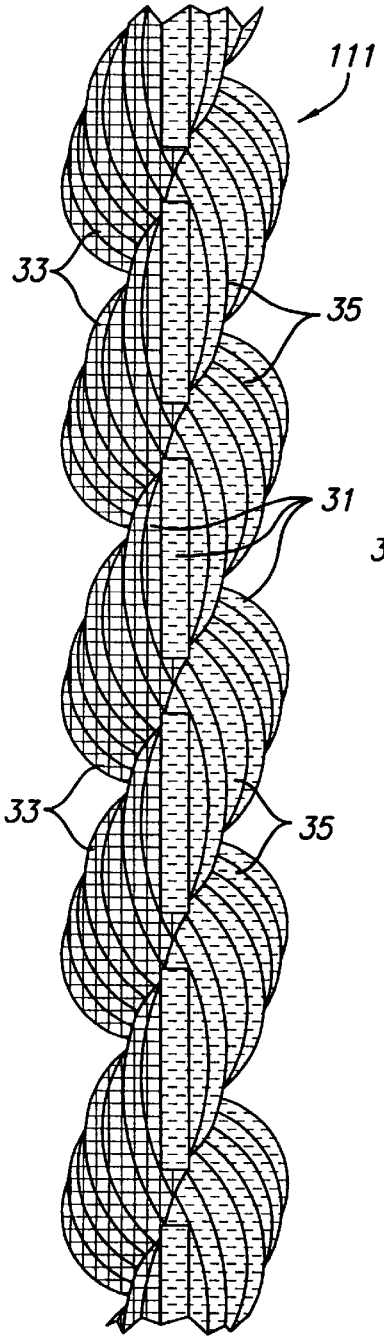
FIG. 15 is an elevational view of section of rope chain manufactured using the style of annular link shown in FIG. 7, and with the orientation of adjacent links reversed every six links along the axis of the rope chain.
Figure 16:
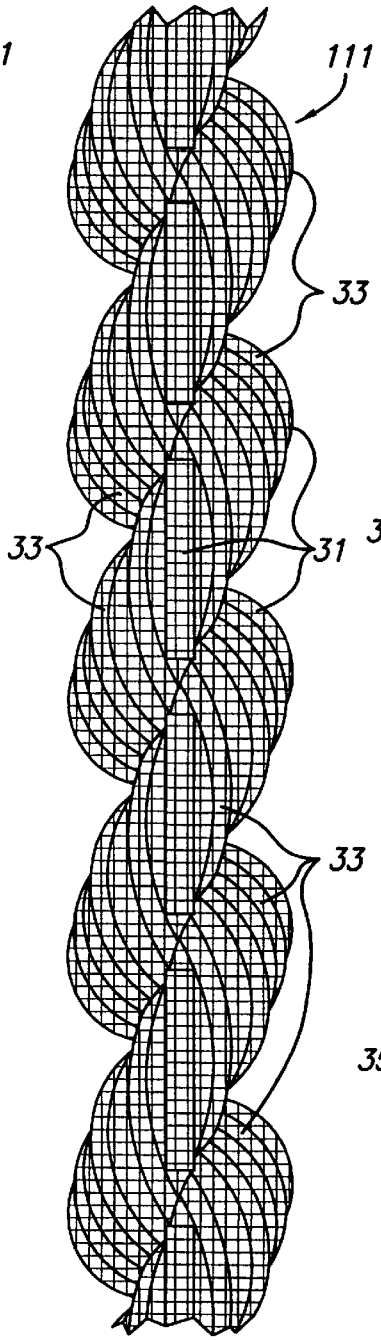
FIG. 16 is a left side elevational view of the segment of rope chain shown in FIG. 15.
Figure 17:
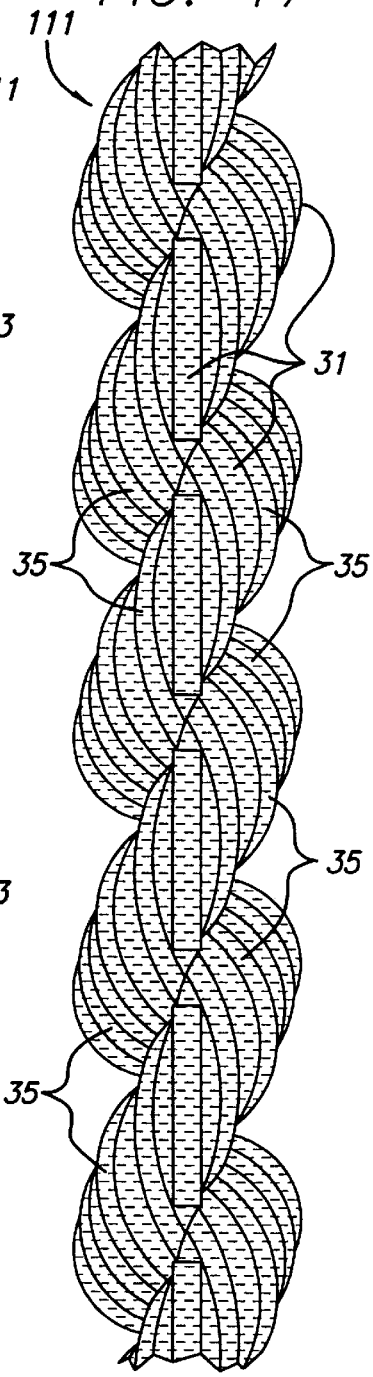
FIG. 17 is a right elevational view of the segment of rope chain shown in FIG. 15.

FIGS. 15–17 show yet another combination of coloring for the rope chain 111. Rope chain 111 is also constructed of annular links 31 (FIG. 7) along the entire length thereof. Rope chain 111 is of a six-link variety in which there are six links per set along the series of annular links. However, the annular links 31 are assembled with the colors matching the colors of adjacent links 31 (i.e., all are in the same axial orientation) for a complete set of six along the chain, and then the links are flipped 180° to be assembled in reverse axial orientation for the next set, and so on. As a result, and since there are six annular links 31 per set, rather than the alternately appearing yellow gold and white gold rope strands shown in FIG. 13, the right side of rope chain 111 in FIG. 15 is all of a white gold color, while the left side is all of a yellow gold color. It will therefore be appreciated that the view of FIG. 15 is taken at the reversal transition point of each set, wherein the edge of the link 31 perpendicular to the page is white gold and all link surfaces exposed to the right of the axis are also white gold, while those link surfaces exposed to the left of the center are yellow gold. The view from the rear of FIG. 15 would be similar. That is, what is shown as lined for the color white gold in FIG. 15 will also appear as white gold, and what is lined for the color yellow gold in FIG. 15 will also appear as yellow gold, but the center links (perpendicular to the page) will be seen as yellow gold from the rear.

From the description of FIG. 15 above, it will be apparent that the view from the left side of FIG. 15 will have an all yellow gold color appearance (FIG. 16), while the right side view of FIG. 15 will have an all white gold appearance (FIG. 17).

The embodiment of FIGS. 15–17 are particularly attractive from the viewpoint that, the rope chain necklace or bracelet may, from one viewpoint, appear to be yellow gold in color, while from another viewpoint may appear to be white gold in color. From other viewpoints, the rope chain 111 gives somewhat of a random coloring impression, again imparting beauty and exciting visual stimuli.

The embodiments of the invention shown in FIGS. 12–17 provide a basis for appreciating the virtually limitless design patterns that can be produced by arranging the differently colored, patterned, or textured annular links such as those shown in FIGS. 6–11 in a rope chain structure.

Further variations of color patterns are presented in FIGS. 18–20. FIGS. 18–20 illustrate the possibility of manufacturing the annular links with either or both planar surfaces having different gold colored areas, shown on the link 120 of FIG. 18 symbolically, as yellow (y), white (w), rose (r), and green (g) areas. The link 122 of FIG. 19 is lined for the gold colors white, yellow, rose, and green for the respective regions 123–126. FIG. 20 shows an annular link 128 having areas 130 and 131 with variations in color, in this example yellow gold areas 130 and white gold areas 131. Importantly, the different-appearing three embodiments shown in FIGS. 12–17 are all constructed with the same multi-colored, or multi-textured annular links 21 and 31 shown in FIGS. 6 and 7, respectively. Even further varieties are possible but not shown.

For example, using the annular link coloring shown in FIG. 7, a rope chain may be constructed using a six-link set, but reversing the direction of the yellow gold and white gold patterns every five links along the rope chain. This arrangement gives yet a further interesting and curious visual impression, since there is somewhat of an overall repeated pattern along the chain, but at any segment of the chain, the coloring appears to be somewhat random. On the other hand, following the channels of such an arrangement, each channel would show a link of white gold on both sides of the channel for a distance, followed by a length of yellow gold on both sides of the channel, followed by another length of white gold, etc.

Examples of a completed rope chain using the configurations for the annular links 41, 51, 61, and 71 shown in FIGS. 8–11 are left to the artisan having the knowledge of the examples given in this specification to follow for guidance.

Obviously, color and texture configurations other than those shown in FIGS. 6–11 and 18–20 are possible for the manufacture of the annular links, and these are merely examples of preferred visual property combinations which can produce striking results in a finished rope chain construction. Accordingly, it is to be understood that the patterns shown in FIGS. 6–11, the types of materials used, the coloring, surface texture, surface patterns, arrangement of groups and sets of links along the rope chain, reversed or not, randomly assembled or in strict accordance with a repeated pattern, and the like are all contemplated possibilities and are to be considered within the scope of the present invention.

FIG. 21 is a perspective view of a gapped link 132, similar to any one of those depicted in FIGS. 1, 6–11, 18, and 19, except that it has flat, but non-planar upper and lower major surfaces 133, 134. That is, a radial cross section taken anywhere along the gapped link 132 will reveal a flat, or linear, upper and lower surface edge, and yet the link 132 is slightly skewed such that the upper and lower surfaces 133, 134 are slightly helical, such that the end faces 135, 136 at the gap are not in registration. The gap dimensions are maintained in accordance with the need to interlink the gapped links to form a rope chain with tightly interconnected link elements. The skewed nature of the gapped link elements making up the rope chain produces interesting visual effects, especially as to reflected light, since there will be no planar, i.e., mirror-like reflections. If desired, only one of the upper and lower surfaces 133, 134 may be made flat; the other, opposite, side surface may be rounded, concave, etched, notched, or configured to any desired shape while maintaining a generally annular link configuration.

Figure 22:
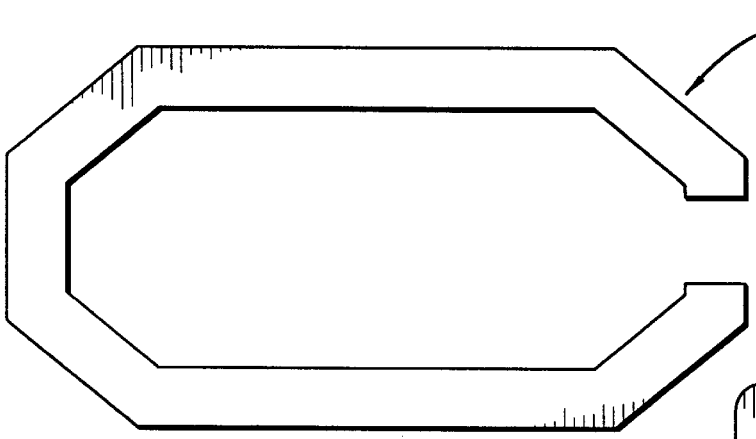
FIG. 22 is a plan view of a ninth example of a rope chain gapped link which has a baguette shape, the link having the possibility of displaying a pattern of regions on the surfaces of the link exhibiting different colors, textures, or other visual properties.
Figure 23:
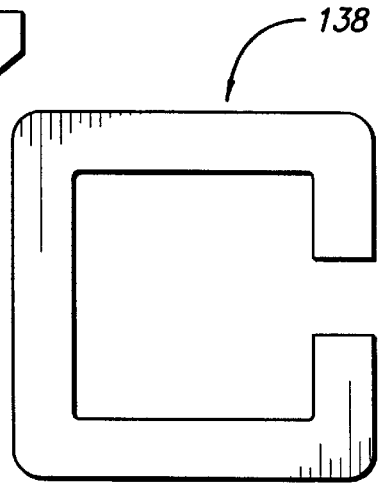
FIG. 23 is a plan view of a tenth example of a rope chain gapped link which has a square shape, the link having the possibility of displaying a pattern of regions on the surfaces of the link exhibiting different colors, textures, or other visual properties.
Figure 24:
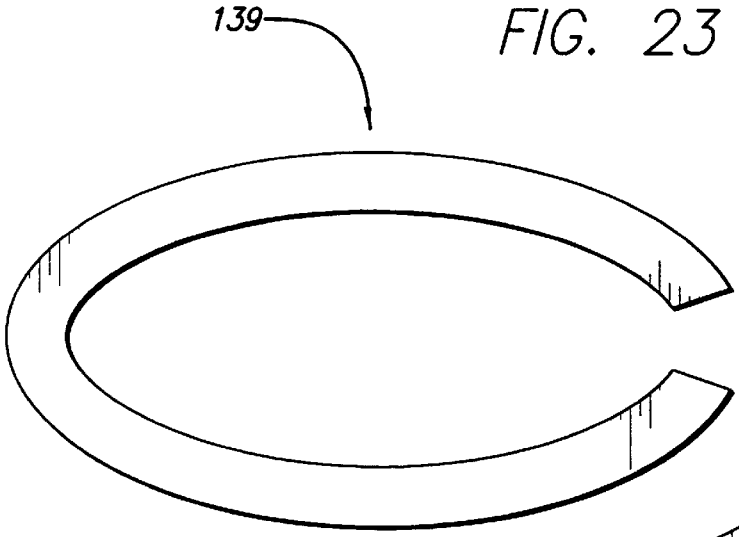
FIG. 24 is a plan view of an eleventh example of a rope chain gapped link which has an oval shape, the link having the possibility of displaying a pattern of regions on the surfaces of the link exhibiting different colors, textures, or other visual properties.
Figure 25:
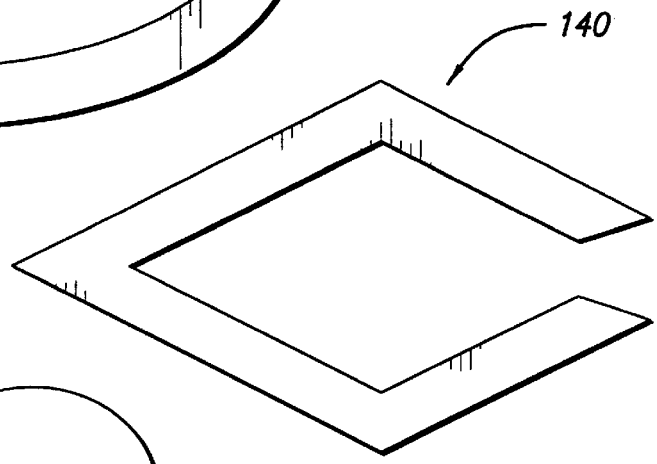
FIG. 25 is a plan view of a twelfth example of a rope chain gapped link which has a diamond shape, the link having the possibility of displaying a pattern of regions on the surfaces of the link exhibiting different colors, textures, or other visual properties.
Figure 26:
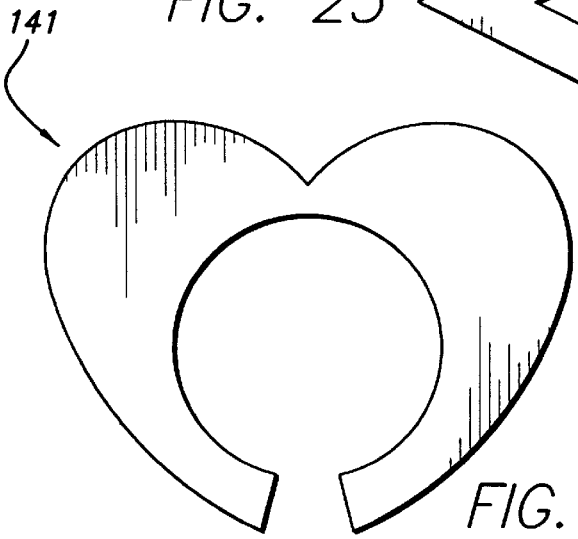
FIG. 26 is a plan view of a thirteenth example of a rope chain gapped link which is heart shaped, the link having the possibility of displaying a pattern of regions on the surfaces of the link exhibiting different colors, textures, or other visual properties.

FIGS. 22–26 show alternate configurations for the gapped links. The link 137 of FIG. 22 is baguette shaped, the link 138 of FIG. 23 is square shaped, the link 139 of FIG. 24 is oval shaped, the link 140 of FIG. 25 is diamond shaped, and the link 141 of FIG. 26 is heart shaped. Any combination of annular, baguette, square, oval, diamond, heart, or other geometric shaped gapped links may be assembled in a virtually limitless variety of combinations to create interesting rope chain jewelry items in accordance with the concepts and methodology of the present invention. For example, a particularly beautiful rope chain design uses a combination of baguette and annular links along the length of the chain. It will be understood that the surface colors, textures, patterns, and/or shapes of the gapped links 137–141 in FIGS. 22–26 may be as varied as those features of the annular links described herein and shown in FIGS. 6–21

While only certain embodiments have been set forth, alternative embodiments and various modifications will be apparent from the above description to those skilled in the art. For example, while the colors and precious metals used in the descriptions herein are preferred to be yellow, white, rose, and green gold, other colors and metals, or even non-metals, can be employed in the construction of the disclosed rope chain configurations. Notable alternate materials, for example, are rhodium (in various colors), silver, and nickel, either solid or plated, or the links may be enameled using any selectable colored or clear enamel. The examples herein of gapped links with a rectangular cross section are not to be considered limiting. Virtually any cross sectional configuration can be produced for the gapped links while maintaining an overall annular configuration, or other configuration not unlike the examples shown in FIGS. 22–26. An attractive rope chain, for example, may be formed using annular gapped links having a circular cross section, solid or tubular, resulting in a "soft feel" rope chain with brilliant light reflection patterns. In this connection, if desired, the interior peripheral edge of the links shown in FIGS. 22–25 may be circular, leaving the exterior peripheral edge as shown. These and other alternatives are considered equivalents and within the spirit and scope of the present invention.

What is claimed is:

1. In a jewelry rope chain of the type comprising a series of tightly interfitting gapped links and having the appearance of intertwining helical strands, the improvement wherein:

at least some of said gapped links comprise multiple segments formed by stamping a multi-segmented material blank, each segment of said multi-segmented material blank exhibiting a different visual property than an adjacent segment of said material blank; and each of said links has a first side surface exhibiting a first visual property and an opposite second side surface exhibiting a second, perceptively different, visual property.

2. The jewelry rope chain as claimed in claim 1, wherein said first and second side surfaces are made of different materials, giving rise to said first and second visual properties.

3. The jewelry rope chain as claimed in claim 1, wherein each said gapped link:

is generally C-shaped;

has an overall configuration selected from the group consisting of annular, square, oval, diamond, heart shaped, and baguette; and is solid in cross section.

4. The jewelry rope chain as claimed in claim 1, wherein each said gapped link:

is generally C-shaped;

has an overall configuration selected from the group consisting of annular, square, oval, diamond, heart shaped, and baguette; and is hollow in cross section.

5. The jewelry rope chain as claimed in claim 1, wherein said series of tightly interfitting gapped links comprises combinations of differently configured gapped links having overall shape configurations selected from the group consisting of annular, square, oval, diamond, heart shaped, and baguette.

6. The jewelry rope chain as claimed in claim 1, wherein said first and second visual properties are color properties.

7. The jewelry rope chain as claimed in claim 1, wherein said first and second visual properties are surface pattern properties.

8. The jewelry rope chain as claimed in claim 1, wherein said first and second visual properties are physical surface appearance properties.

9. The jewelry rope chain as claimed in claim 1, wherein said first surface of each of said links face the same direction along said series of links.

10. The jewelry rope chain as claimed in claim 1, wherein:

said first surface of each of a first contiguous group of said series of links face in a forward direction along said series of links;

said first surface of each of a second contiguous group of said series of links face in a direction opposite said forward direction along said series of links; and like groups of said first and second contiguous groups of links alternate along said series of links.

11. The jewelry rope chain as claimed in claim 1, wherein:

said first surface of each of a first contiguous group of said series of links exhibit a first visual property for a prescribed length along said series of links;

said first surface of each of a second contiguous group of said series of links exhibit a second visual property for a prescribed length along said series of links; and like groups of said first and second contiguous groups of links alternate along said series of links.

12. The jewelry rope chain as claimed in claim 11, wherein each of said first and second contiguous groups of links comprise the same number of links.

13. The jewelry rope chain as claimed in claim 11, wherein said first contiguous group of links comprises a number of links different from the number of links in said second contiguous group.

14. The jewelry rope chain as claimed in claim 11, wherein:

said links in said series of links are arranged in a systematic and repeated pattern, said pattern repeating every X number of links along said series of links; and the number of links in each of said first and second contiguous groups of links is equal to X.

15. The jewelry rope chain as claimed in claim 11, wherein:

said links in said series of links are arranged in a systematic and repeated pattern, said pattern repeating every X number of links along said series of links; and the number of links in each of said first and second contiguous groups of links is not equal to X.

16. The jewelry rope chain as claimed in claim 1, wherein:

at least one of said first and second side surfaces of each said gapped link is flat along a cross section of said gapped link.

17. The jewelry rope chain as claimed in claim 16, wherein:

said at least one said side surface is planar.

18. The jewelry rope chain as claimed in claim 16, wherein:

said at least one said side surface is non-planar.

19. In a jewelry rope chain of the type comprising a series of tightly interfitting gapped links and having the appearance of intertwining helical strands, each gapped link having spaced ends defining a gap therebetween, each of said gapped links having a first side surface and an opposite second side surface, the improvement wherein:

each said first side surface of at least some of said gapped links is divided into portions disposed according to a predetermined pattern along the span of said link between said ends, each first side surface portion exhibiting a first visual property perceptively different than a second visual property exhibited by an adjacent first side surface portion.

20. The jewelry rope chain as claimed in claim 19, wherein:

each said second side surface of at least some of said gapped links is divided into portions, each second side surface portion exhibiting a third visual property perceptively different than a fourth visual property exhibited by an adjacent second side surface portion.

21. The jewelry rope chain as claimed in claim 20, wherein said surface portions are made of different materials, giving rise to said first and second visual properties.

22. The jewelry rope chain as claimed in claim 19, wherein each said gapped link:

is generally C-shaped;

has an overall configuration selected from the group consisting of annular, square, oval, diamond, heart shaped, and baguette; and is solid in cross section.

23. The jewelry rope chain as claimed in claim 19, wherein each said gapped link:

is generally C-shaped;

has an overall configuration selected from the group consisting of annular, square, oval, diamond, heart shaped, and baguette; and is hollow in cross section.

24. The jewelry rope chain as claimed in claim 19, wherein said series of tightly interfitting gapped links comprises combinations of differently configured gapped links having overall shape configurations selected from the group consisting of annular, square, oval, diamond, heart shaped, and baguette.

25. The jewelry rope chain as claimed in claim 19, wherein said first and second visual properties on said first side portions are color.

26. The jewelry rope chain as claimed in claim 20, wherein said third and fourth visual properties on said second side portions are color.

27. The jewelry rope chain as claimed in claim 19, wherein said first and second visual properties on said first side portions are physical surface appearance.

28. The jewelry rope chain as claimed in claim 20, wherein said third and fourth visual properties on said second side portions are physical surface appearance.

29. The jewelry rope chain as claimed in claim 20, wherein said first surface of each of said links face the same direction along said series of links.

30. The jewelry rope chain as claimed in claim 19, wherein:

said first surface of each of a first contiguous group of said series of links face in a forward direction along said series of links;

said first surface of each of a second contiguous group of said series of links face in a direction opposite said forward direction along said series of links; and like groups of said first and second contiguous groups of links alternate along said series of links.

31. The jewelry rope chain as claimed in claim 30, wherein each of said first and second contiguous groups of links comprise the same number of links.

32. The jewelry rope chain as claimed in claim 30, wherein said first contiguous group of links comprises a number of links different from the number of links in said second contiguous group.

33. The jewelry rope chain as claimed in claim 30, wherein:

said links in said series of links are arranged in a systematic and repeated pattern, said pattern repeating every X number of links along said series of links; and the number of links in each of said first and second contiguous groups of links is equal to X.

34. The jewelry rope chain as claimed in claim 30, wherein:

said links in said series of links are arranged in a systematic and repeated pattern, said pattern repeating every X number of links along said series of links; and the number of links in each of said first and second contiguous groups of links is not equal to X.

35. The jewelry rope chain as claimed in claim 19, wherein:

at least one of said first and second side surfaces of each said gapped link is flat along a cross section of said gapped link.

36. The jewelry rope chain as claimed in claim 35, wherein:

said at least one said side surface is planar.

37. The jewelry rope chain as claimed in claim 35, wherein:

said at least one said side surface is non-planar.

38. A method for manufacturing a jewelry rope chain, comprising:

providing a multi-segmented material blank, each segment of said multi-segmented material blank exhibiting a different visual property than an adjacent segment of said material blank;

stamping a plurality of gapped links from said multi-segmented material blank, each of said gapped links having a first side surface exhibiting a first visual property and an opposite second side surface exhibiting a second, perceptively different, visual property; and tightly interfitting a series of said gapped links to construct a length of rope chain having the appearance of intertwining helical strands.

39. The method as claimed in claim 38, wherein said first and second side surfaces are made of different materials, giving rise to said first and second visual properties.

40. The method as claimed in claim 38, including the steps of forming each said gapped link:

into a generally C-shaped;

to have an overall configuration selected from the group consisting of annular, square, oval, diamond, heart shaped, and baguette; and with a solid cross section.

41. The method as claimed in claim 38, including the steps of forming each said gapped link:

into a generally C-shaped;

to have an overall configuration selected from the group consisting of annular, square, oval, diamond, heart shaped, and baguette; and with a hollow cross section.

42. The method as claimed in claim 38, wherein said series of tightly interfitting gapped links comprises combinations of differently configured gapped links having overall shape configurations selected from the group consisting of annular, square, oval, diamond, heart shaped, and baguette.

43. The method as claimed in claim 38, wherein:

said first and second visual properties are color.

44. The method as claimed in claim 38, wherein:

said first and second visual properties are physical surface appearance.

45. The method as claimed in claim 38, wherein:

said first surface of each of said links is oriented to face in the same direction along said series of links.

46. The method as claimed in claim 38, wherein:

said first surface of each of a first contiguous group of said series of links is oriented to face in a forward direction along said series of links;

said first surface of each of a second contiguous group of said series of links is oriented to face in a direction opposite said forward direction along said series of links; and like groups of said first and second contiguous groups of links are arranged to alternate along said series of links.

47. The method as claimed in claim 38, wherein:

said first surface of each of a first contiguous group of said series of links exhibit a first visual property for a prescribed length along said series of links;

said first surface of each of a second contiguous group of said series of links exhibit a second visual property for a prescribed length along said series of links; and said method includes alternating like groups of said first and second contiguous groups of links along said series of links.

48. The method as claimed in claim 47, wherein:

each of said first and second contiguous groups of links comprise the same number of links.

49. The method as claimed in claim 47, wherein:

said first contiguous group of links comprises a number of links different from the number of links in said second contiguous group.

50. The method as claimed in claim 47, wherein:

said links in said series of links are arranged in a systematic and repeated pattern, said pattern repeating every X number of links along said series of links; and the number of links in each of said first and second contiguous groups of links is equal to X.

51. The method as claimed in claim 47, wherein:

said links in said series of links are arranged in a systematic and repeated pattern, said pattern repeating every X number of links along said series of links; and the number of links in each of said first and second contiguous groups of links is not equal to X.

52. A method for manufacturing a jewelry rope chain, comprising:

providing a plurality of gapped links, each gapped link having spaced ends defining a gap therebetween, each of said gapped links having a first side surface and an opposite second side surface, the first side surface of at least some of said gapped links being divided into portions disposed according to a predetermined pattern along the span of said link between said ends, each said first side surface portion exhibiting a first visual property perceptively different than a second visual property exhibited by an adjacent first side surface portion; and tightly interfitting a series of said gapped links to construct a rope chain having the appearance of intertwining helical strands.

53. The method as claimed in claim 52, wherein:

the second side surface of at least some of said gapped links is divided into portions, each said second side surface portion exhibiting a third visual property perceptively different than a fourth visual property exhibited by an adjacent second side surface portion.

54. The method as claimed in claim 52, wherein said surface portions are made of different materials, giving rise to said first and second visual properties.

55. The method as claimed in claim 52, wherein said first and second side surfaces are substantially planar.

56. The method as claimed in claim 52, including the steps of forming each said gapped link:

into a generally C-shaped;

to have an overall configuration selected from the group consisting of annular, square, oval, diamond, heart shaped, and baguette; and with a solid cross section.

57. The method as claimed in claim 52, including the steps of forming each said gapped link:

into a generally C-shaped;

to have an overall configuration selected from the group consisting of annular, square, oval, diamond, heart shaped, and baguette; and with a hollow cross section.

58. The method as claimed in claim 57, wherein said series of tightly interfitting gapped links comprises combinations of differently configured gapped links having overall shape configurations selected from the group consisting of annular, square, oval, diamond, heart shaped, and baguette.

59. The method as claimed in claim 52, wherein:

said visual property on said first and second side portions is color.

60. The method as claimed in claim 52, wherein:

said visual property on said first and second side portions is physical surface appearance.

61. The method as claimed in claim 52, wherein:

said first surface of each of said links are oriented to face the same direction along said series of links.

62. The method as claimed in claim 52, wherein:

said first surface of each of a first contiguous group of said series of links are arranged to face in a forward direction along said series of links;

said first surface of each of a second contiguous group of said series of links are arranged to face in a direction opposite said forward direction along said series of links; and like groups of said first and second contiguous groups of links are arranged to alternate along said series of links.

63. The method as claimed in claim 62, wherein:

each of said first and second contiguous groups of links comprise the same number of links.

64. The method as claimed in claim 52, wherein:

said first surface of each of a first contiguous group of said series of links exhibit a first visual property for a prescribed length along said series of links;

said first surface of each of a second contiguous group of said series of links exhibit a second visual property for a prescribed length along said series of links; and said method includes alternating like groups of said first and second contiguous groups of links along said series of links.

65. The method as claimed in claim 64, wherein:

said first contiguous group of links comprises a number of links different from the number of links in said second contiguous group.

66. The method as claimed in claim 64, wherein:

said links in said series of links are arranged in a systematic and repeated pattern, said pattern repeating every X number of links along said series of links; and the number of links in each of said first and second contiguous groups of links is equal to X.

67. The method as claimed in claim 65, wherein:

said links in said series of links are arranged in a systematic and repeated pattern, said pattern repeating every X number of links along said series of links; and the number of links in each of said first and second contiguous groups of links is not equal to X.

68. A jewelry rope chain comprising a series of tightly interfitting gapped links having the appearance of intertwining helical strands with a helical channel being defined between intertwined first and second helical strands, said first and second helical strands exhibiting at least two distinctly different visual properties along the length of said helical channel.

69. The jewelry rope chain as claimed in claim 68, wherein:

said first helical strand exhibits a visual property along said helical channel different from the visual property exhibited along said channel by said second helical strand.

70. The jewelry rope chain as claimed in claim 68, wherein:

the visual property exhibited by said first helical strand is a first color, and the visual property exhibited by said second helical strand is a second color, different than said first color.

71. The jewelry rope chain as claimed in claim 68, wherein:

the visual property exhibited by said first helical strand is a predetermined changing of colors along the length of said helical channel according to a first color change scheme; and the visual property exhibited by said second helical strand is a predetermined changing of colors along the length of said helical channel according to a second color change scheme.

72. The jewelry rope chain as claimed in claim 71, wherein:

said first color change scheme and said second color change scheme are identical but relatively displaced along the length of said rope chain.

73. The jewelry rope chain as claimed in claim 71, wherein:

both said first and second color change schemes produce alternating colors along the length of said helical channel.

74. The jewelry rope chain as claimed in claim 68, wherein:

said first and second helical strands exhibit at least two distinctly different visual properties along a first length of said rope chain; and said first and second helical strands exhibit at least two distinctly different visual properties along a second length of said rope chain.

75. The jewelry rope chain as claimed in claim 68, comprising a plurality of said first lengths of said rope chain alternating with a plurality of said second lengths of said rope chain.

* * * * *